US006709708B2

(12) United States Patent
Dinh et al.

(10) Patent No.: US 6,709,708 B2
(45) Date of Patent: Mar. 23, 2004

(54) IMMERSION COATING SYSTEM

(75) Inventors: Kenny-tuan T. Dinh, Webster, NY (US); Richard H. Nealey, Penfield, NY (US); John G. Matta, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 16 days.

(21) Appl. No.: 09/894,655

(22) Filed: Jun. 28, 2001

(65) Prior Publication Data

US 2001/0037766 A1 Nov. 8, 2001

Related U.S. Application Data

(62) Division of application No. 09/466,348, filed on Dec. 17, 1999, now Pat. No. 6,312,522.

(51) Int. Cl.[7] ..... B05D 1/18

(52) U.S. Cl. ..... 427/384; 427/372.2; 427/430.1; 427/388.1; 427/388.4; 427/388.5; 118/404; 118/407; 118/503; 118/504; 118/505; 118/501

(58) Field of Search ..... 427/430.1, 435, 427/372.2, 388.1, 384, 388.4, 388.5; 118/407, 404, 505, 501, 503, 504, DIG. 11, DIG. 12

(56) References Cited

U.S. PATENT DOCUMENTS

| | | | | |
|---|---|---|---|---|
| 3,117,028 A | * | 1/1964 | Kaulen | 118/404 |
| 4,265,990 A | | 5/1981 | Stolka et al. | 430/59 |
| 4,390,611 A | | 6/1983 | Ishikawa et al. | 430/59 |
| 4,551,404 A | | 11/1985 | Hiro et al. | 430/59 |
| 4,588,667 A | | 5/1986 | Jones et al. | 430/73 |
| 4,596,754 A | | 6/1986 | Tsutsui et al. | 430/58 |
| 4,797,337 A | | 1/1989 | Law et al. | 430/58 |

* cited by examiner

*Primary Examiner*—Katherine A. Bareford
(74) *Attorney, Agent, or Firm*—Fay, Sharpe, Fagan, Minnich & McKee, LLP

(57) ABSTRACT

A coating process involving a hollow cylinder, a hollow shaft coaxial with the cylinder connecting a first and a second spacing device, mounting thereon on a vertical rod which is concentric to and mounted within a cylindrical coating vessel having a top and bottom, introducing coating liquid into the vessel adjacent to the bottom and withdrawing the liquid thereby depositing a layer of the coating liquid on the outside of the hollow cylinder and wherein a liquid seal is formed between the top and bottom of the cylinder and the hollow shaft.

15 Claims, 4 Drawing Sheets

IMMERSION COATING SYSTEM

This application is a divisional of application Ser. No. 09/466,348, filed Dec. 17, 1999, now U.S. Pat. No. 6,312, 522.

BACKGROUND OF THE INVENTION

This invention relates in general to a coating system and, more specifically, to a system for immersion coating of drums.

Electrophotographic imaging members are well known. Typical electrophotographic imaging members include photosensitive members (photoreceptors) that are commonly utilized in electrophotographic (xerographic) processes in either a flexible belt or a rigid drum configuration. These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photo generating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer may be sandwiched between the supporting electrode and a photoconductive layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

Electrophotographic imaging drums may be coated by many different techniques such as spraying coating or immersion (dip) coating. Dip coating is a coating method typically involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed.

The need for faster printing speed, e.g., up to about 75 pages per min and printing two pages side by side has lead to the development of long, large diameter drum substrates, instead of shorter small diameter drums. The larger diameter drums also provide more surface area around the periphery of the drum to locate large, space consuming development stations. For such requirements, the drum dimension can be 38 centimeters (15 inches) in diameter and 76 centimeters (30 inches) in length. As the size and weight of the substrate is increased, the problems involving in inserting and withdrawing the substrate from a coating vessel are compounded. Thus, for example, dip coating of large heavy hollow cylinders requires large quantities of coating liquid which can be wasteful if the coating liquid has a short pot life. Moreover, vibration or wobble during transport of a large heavy drum into and out of a coating liquid can cause undesirable coating defects.

Another technique for immersion coating comprises (a) positioning the substrate within a coating vessel to define a space between the vessel and the substrate and providing a downwardly inclined surface contiguous to the outer surface at the end region of the substrate; (b) filling at least a portion of the space with a coating solution; and (c) withdrawing the coating solution from the space, thereby depositing a layer of the coating solution on the substrate. This process is described in U.S. Pat. No. 5,616,365, the entire disclosure thereof being incorporated herein by reference. When this process is utilized for coating a large drum, e.g. 24 centimeters (9.5 inches) in diameter, in which coating fluid is withdrawn at the bottom to deposit a coating layer on the drum located in the center of a coating vessel, it can produce uniform and defect free coating for thin undercoating layers and thick charge transport layers. However, when drums are dip coated in essentially a closed environment using a minimum amount of coating fluid and without requiring precise motion control of potentially massive substrates over large distances as in the system described in U.S. Pat. No. 5,616,365, it has been found that substrate is not always centered when inserted into a coating vessel for a coating operation. Non-uniform coatings can be formed when the spacing between the outside surface of the drum being coated and the adjacent coating vessel wall is not uniform completely around the outer surface of the drum.

These defects are unacceptable for high printing quality requirements such as extremely uniform thickness and defect free coatings. Solutions to these coating problems are crucial for complex, advanced precision tolerance imaging systems.

INFORMATION DISCLOSURE STATEMENT

U.S. Pat. No. 5,616,365 to Nealey, issued Apr. 1, 1997—A method is disclosed for coating a substrate having an end region including: (a) positioning the substrate within a coating vessel to define a space between the vessel and the substrate and providing a downwardly inclined surface contiguous to the outer surface at the end region of the substrate; (b) filling at least a portion of the space with a coating solution; and (c) withdrawing the coating solution from the space, thereby depositing a layer of the coating solution on the substrate.

U.S. Pat. No. 5,693,372 to Mistrater et al, issued Dec. 2, 1997—A process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

U.S. Pat. No. 5,725,667 to Petropoulos et al, issued Mar., 10, 1998—There is disclosed a dip coating apparatus including: (a) a single coating vessel capable of containing a batch of substrates vertically positioned in the vessel, wherein there is absent vessel walls defining a separate compartment for each of the substrates; (b) a coating solution disposed in the vessel, wherein the solution is comprised of materials employed in a photosensitive member and including a solvent that gives off a solvent vapor; and (c) a solvent vapor uniformity control apparatus which minimizes any difference in solvent vapor concentration encountered by the batch of the substrates in the air adjacent the solution surface, thereby improving coating uniformity of the substrates.

U.S. Pat. No. 5,820,897 to Chambers et al, issued Oct. 13, 1998—This invention discloses a method of holding and transporting a hollow flexible belt throughout a coating process. The method includes placing an expandable insert into the hollow portion of a seamless flexible belt, and expanding the insert until it forms a chucking device with a protrusion on at least one end. A mechanical handling device is then attached to the protrusion, and will be used to move the chuck and the belt through the dipping process, as materials needed to produce a photosensitive device are deposited onto the surface of the belt, allowing it to be transformed into an organic photoreceptor. The chucking device and flexible belt are then removed from the mechanical handling device, the belt is cut to the desired width, and the chuck is removed from the inside of the photoreceptor.

CROSS REFERENCE TO COPENDING APPLICATIONS

In U.S. patent application Ser. No. 09/466,565, entitled "IMMERSION COATING PROCESS", filed concurrently herewith in the names of Dinh et al., there is disclosed a process is disclosed for immersion coating of a substrate including positioning a substrate having a top and bottom within a coating vessel having an inner surface to define a space between the inner surface and the substrate, filling at least a portion of the space with a coating mixture; stopping the filling slightly below the top of the substrate, initiating removal of the coating mixture at a gradually increasing rate to a predetermined maximum flow rate in a short predetermined distance, and continuing removal of the coating mixture at substantially the predetermined maximum flow rate to deposit a layer of the coating mixture on the substrate. The aforementioned co-pending application is assigned to Xerox Corporation.

The entire disclosure of the above patent application is incorporated herein by reference.

BRIEF SUMMARY OF THE INVENTION

It is, therefore, an object of the present invention to provide an improved immersion coating system that overcomes the above noted deficiencies.

It is another object of the present invention to provide an improved immersion coating system that forms uniform coatings.

It is still another object of the present invention to provide an improved immersion coating system that forms coatings on large cylindrical substrates.

It is yet another object of the present invention to provide an improved immersion coating system that more precisely centers cylinders within a cylindrical coating chamber to form uniform coatings during withdrawal of coating mixtures from the coating vessel.

It is another object of the present invention to provide an improved immersion coating system that allows smooth and even withdrawal of the coating solutions from a coating chamber.

It is still another object of the present invention to provide an improved layered electrostatographic imaging member whereby the interior surface of the object to be coated is protected from a coating solution by a suitable seal arrangement.

The foregoing objects and others are accomplished in accordance with this invention by providing a coating process comprising providing an assembly comprising a hollow cylinder having an upper end and a lower end sandwiched between and in pressure contact with a first spacing device and a second spacing device, a hollow shaft coaxial with the cylinder connecting the first spacing device and the second spacing device, mounting the assembly on a vertical rod which is concentric to and mounted within a cylindrical coating vessel having a top and bottom, introducing coating liquid into the coating vessel adjacent to the bottom to immerse most of the cylinder, and withdrawing the liquid from the coating vessel adjacent to the bottom to deposit a layer of the coating liquid on the cylinder.

This invention also comprises apparatus for carrying out the coating process of this invention.

DESCRIPTION OF THE DRAWINGS

A more complete understanding of the present invention can be obtained by reference to the accompanying drawings wherein.

These figures merely schematically illustrates the invention and is not intended to indicate relative size and dimensions of the device or components thereof.

DETAILED DESCRIPTION OF THE DRAWINGS

Figure 1:
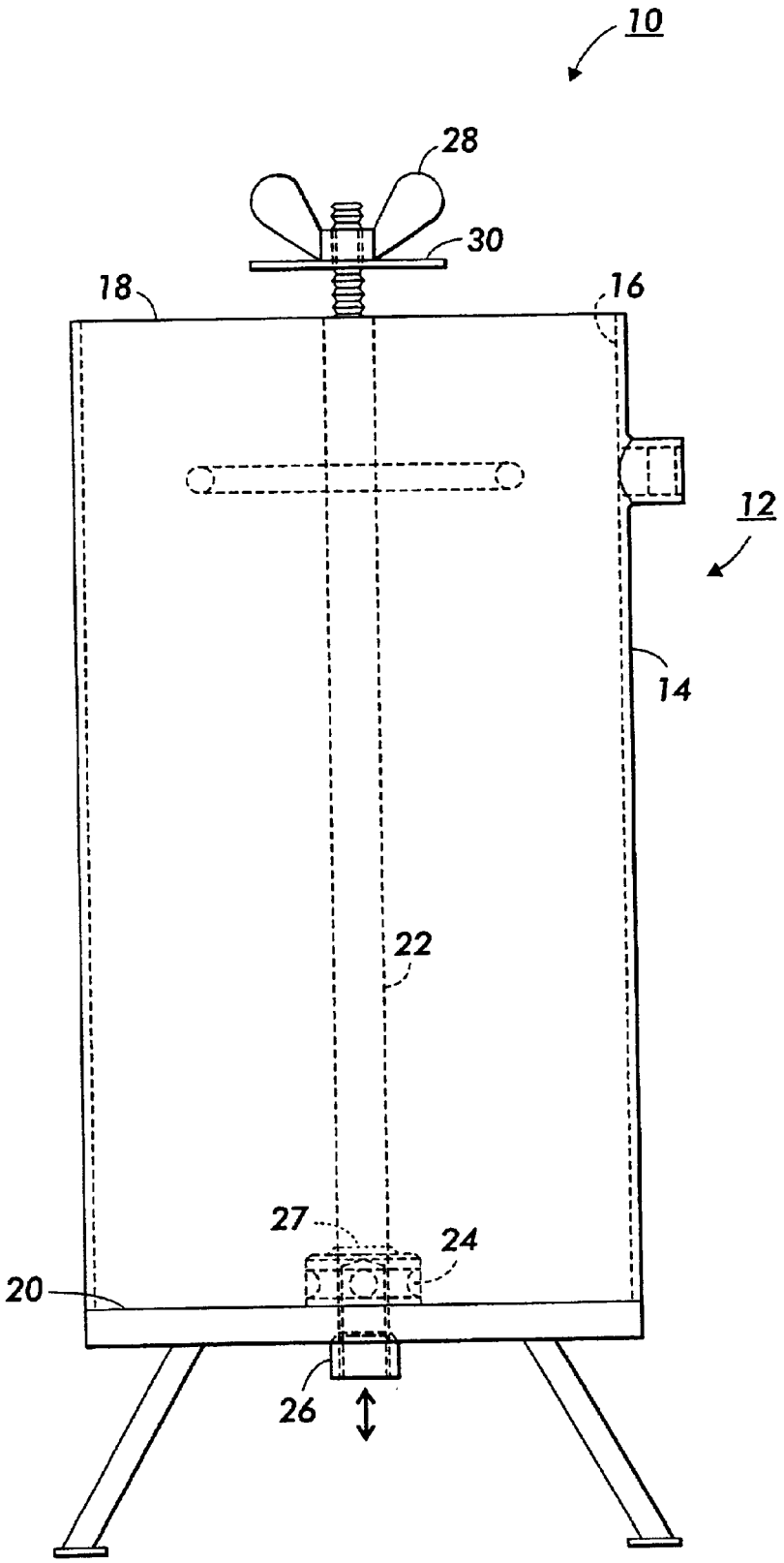
FIG. 1 is a schematic partial cross-sectional view in elevation of a cylindrical coating vessel having a concentrically positioned vertical rod.

Referring to FIG. 1, an immersion coating system 10 is shown comprising a coating vessel 12 comprising a vertical wall 14 having a vertical interior surface 16 having a circular cross section and an imaginary vertical axis. Coating vessel 12 also has an open top 18 and a bottom 20. A vertical shaft 22 is supported on the bottom 20 of the coating vessel 12. Shaft 22 has an axis aligned coaxially with the imaginary vertical axis of the vertical interior surface 16 having the circular cross section. The vertical shaft 22 secured to the bottom 20 of the coating vessel 12 by any suitable technique. Typical techniques include, for example, threads to facilitate screwing, welding, and the like. Vertical shaft 22 should be rigid and exhibit resistance to flexing. Preferably, vertical shaft 22 is solid and comprises a high strength material such as, for example, stainless steel, and the like.

A preferred combination coating liquid inlet and coating outlet 24 is located at the base of shaft 22. A center coating liquid feed in the location below the bottom end of the cylinder to be coated provides more uniform flow of the coating fluid under controlled velocity into and out of the coating vessel 12 at a constant rate to provide a uniform coating thickness on the substrate. Combination coating liquid inlet and coating liquid outlet 24 is also adjacent to the bottom of the coating vessel 12. A coupling 26 is connected to a suitable conduit (not shown) to transport coating liquid to and from outlet 24. An optional cone ring 27 may be used at the base of vertical shaft 22 and supported on combination coating liquid inlet and coating liquid outlet 24. Although less desirable, separate coating liquid inlets and outlets may be utilized with some of the holes in outlet 24 serving as inlet ports and other holes serving as outlet ports, the ports being connected to different conduits (not shown). Moreover, separate inlets and outlets located elsewhere (not shown) at or near the bottom of the coating vessel 12 may be utilized, such as those illustrated in U.S. Pat. No. 5,616,365, the entire disclosure thereof being incorporated herein by reference. The coating liquid inlets and outlets should be located at a level below the bottom of cylindrical substrates (see FIG. 3) being coated in the coating vessel 12 to achieve more uniform flow, thereby resulting in more uniform coatings. Thus, the cylindrical substrate is positioned off the bottom of the coating vessel to allow coating liquid inlets and outlets to be located at a level below the bottom end of the cylindrical substrate. The liquid inlets and outlets should be positioned so that uniform flow is maintained around the drum during withdrawal of the coating solution or dispersion. Thus, the coating liquid inlet/outlet adjacent to the bottom of the coating vessel may be separate or combined ports. A removable wing nut 28 and washer 30 are utilized in combination with vertical shaft 22 to maintain cylindrical substrates (see FIG. 3) coaxially aligned with vertical interior surface 16 of coating vessel 12 during coating operations. Washer 30 may optionally be a washer and cone ring combination (not shown), the cone portion of the washer facing downwardly.

Figure 2:
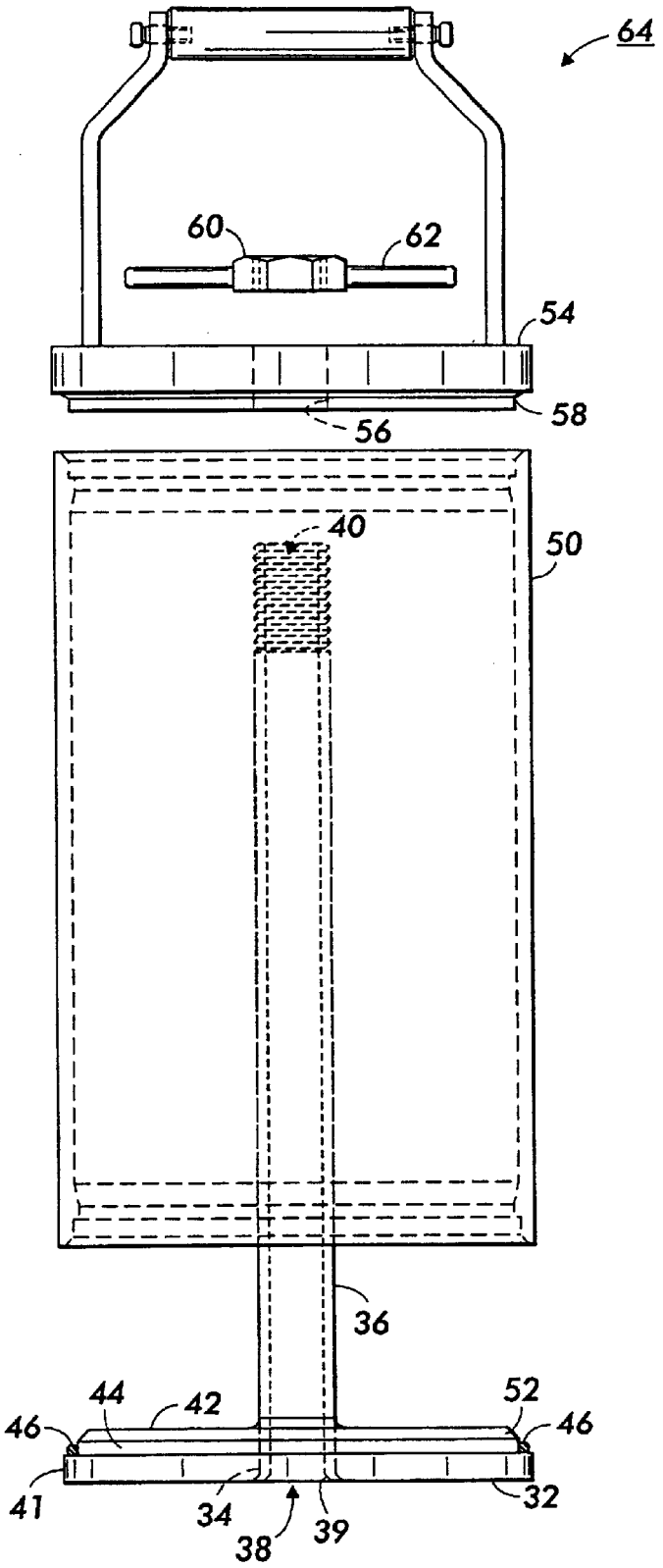
FIGS. 2 and 3 are a schematic partial sectional view in elevation of an exploded view and assembled view, respectively, of an assembly having an upper end and a lower end sandwiched between and in pressure contact with a first spacing device and a second spacing device.
Figure 3:
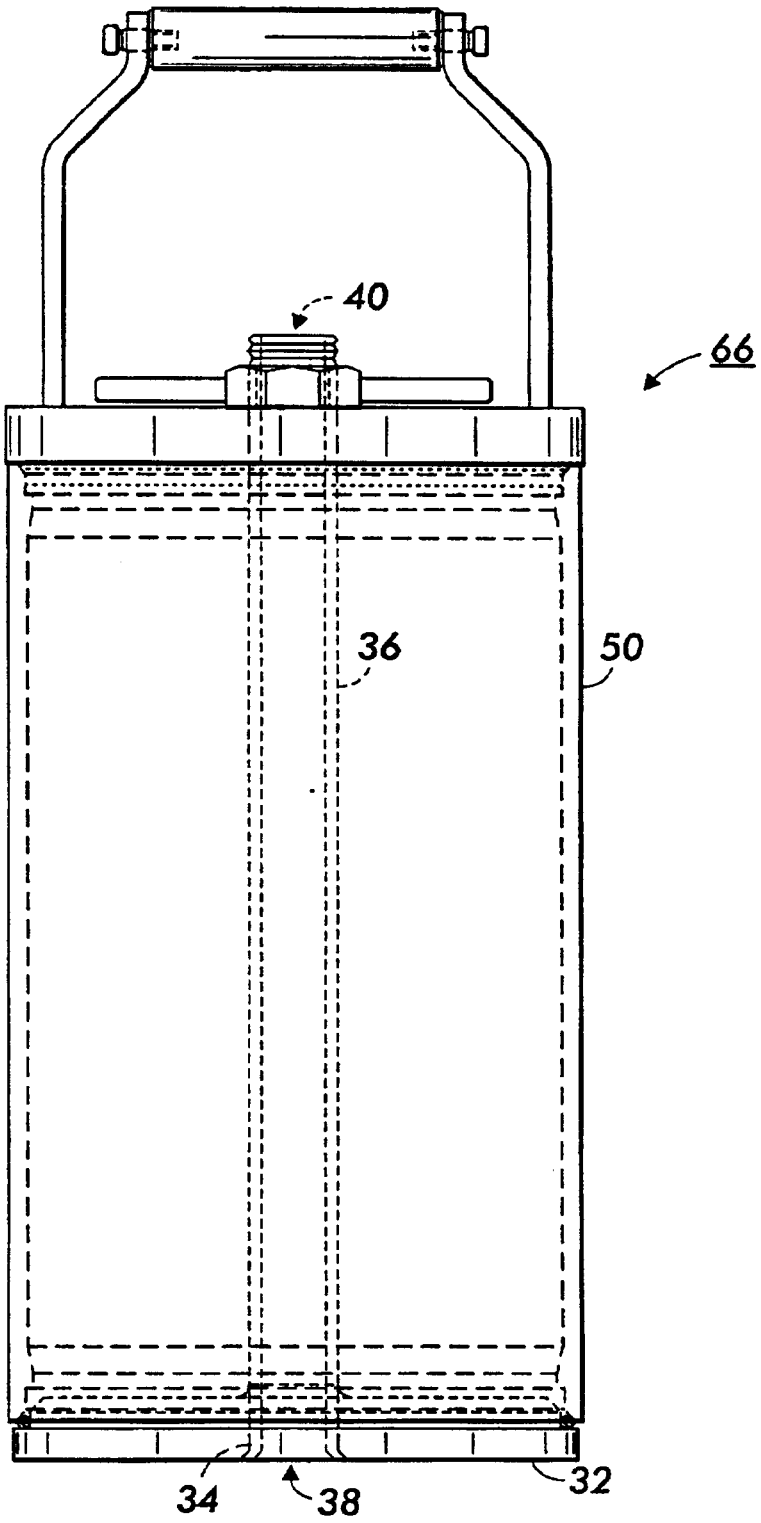

Referring to both the exploded and assembled views in FIGS. 2 and 3, a first spacing device 32 having a centered hole 34 and a hollow shaft 36 having a first open end 38 and a second open end 40 are shown. The first open end 38 is secured to the first spacing device 32 and aligned with the centered hole 34. The bottom of hole 34 or the end of open end 38 (if it extends all the way through first open 38 may have a flared opening 39 to mate with the inclined surface of cone ring 27 (see FIG. 1). Mating of flared opening 39 and the inclined surface of cone ring 27 assists in centering the bottom of the hollow shaft 36 and first spacing device 32 so that the hollow cylinder 50 is concentric with the vertical interior surface 16 of coating vessel 12. The connection between first open end 38 and first spacing device 32 is liquid tight. The centered hole 34, first open end 38, and hollow shaft 36 are adapted to slide onto and align coaxially with the vertical shaft 22 supported on the bottom 20 of the coating vessel 12 (see FIGS. 1 and 4) whereby the vertical shaft 22 extends beyond the second open end of the hollow shaft 36 (see FIG. 4). The inside diameter of hollow shaft 36 should be slightly larger than the outside diameter of vertical shaft 22 to allow vertical shaft 22 to be slid into the interior of hollow shaft 36. The fit should be sufficient to avoid any noticeable play after the vertical shaft 22 is slid into the interior of hollow shaft 36.

The outer periphery 41 of upper surface 42 of first spacing device 32 may have a ledge or lip 44 to receive a seal 46 which mates with the bottom edge 48 of hollow cylinder 50. Instead of a ledge or lip 44, the seal 46 may alternatively be retained in place by a groove (not shown) in the upper surface of first spacing device 32 or any other suitable structure. The upper portion 52 of ledge 44 may be chamfered to assist in centering hollow cylinder 50 on first spacing device 32 so that hollow cylinder 50 is coaxially aligned with the axis of hollow shaft 36. A liquid tight fit between the first spacing device 32 and bottom edge 48 of hollow cylinder 50 ensures that coating material does not leak into and coat the interior of hollow cylinder 50. The seal 46 is preferably made of a compressible material to insure that no coating solution penetrates to the interior of the hollow cylinder 50. Any suitable seal material may utilized for seal 46. The composition of the seal member should be chosen to be compatible with the solvent used in the coating operation. Typical materials for seals include, for example, fluorinated polymers, such as Teflon (polytetrafluoroethylene), ethylene-propylene copolymer, nitrile (Buna N), Kevlar™, polyvinylidene fluoride, neoprene, and the like. The seal may have any suitable cross sectional shape. Typical shapes include, for example, round, oval, flat, and the like. First spacing device 32 and the attached hollow shaft have no holes which would allow leakage of liquids into the interior of the hollow cylinder after the cylinder has been mounted against seal 46.

A second spacing device 54 having a centered hole 56 adapted to slide onto the second open end 40 of the hollow shaft 36. Second spacing device 54 has a ledge 58 to assist in centering hollow cylinder 50 on second spacing device 54 so that hollow cylinder 50 is coaxially aligned with the axis of hollow shaft 36. The centered hole 56 has a diameter slightly larger than the outside diameter of hollow shaft 36 to allow second spacing device 54 to be slid over the exterior surface of hollow shaft 36. The fit should be sufficient to avoid any noticeable play after the centered hole 56 is slid onto hollow shaft 36. Although the second spacing device 54 is shown as a solid disc or flange, any other suitable device which provides the proper coaxial alignment between the hollow shaft 36 and the hollow cylinder 50 may be substituted for the solid disk. For example, instead of a solid disk, the disc may be perforated (not shown) to reduce weight and conserve material. Similarly, a spider arrangement similar to a wagon wheel hub with spokes radiating from the hub (not shown) may alternatively be used. The hub would slide over hollow shaft 36 and the spokes may have lips which grip the upper end of the hollow cylinder 50 to maintain the desired concentric alignment. Alternatively, the second spacing device 54 may be a bar. A suitable first fastening mechanism is employed at the upper end of hollow shaft 36 to sandwich hollow cylinder 50 between first spacing device 32 and second spacing device 54. The upper end of hollow shaft 36 may be threaded to receive nut 60 with extension bars 62 to assist in tightening nut 60. If desired, any suitable alternative fastening mechanism such as cam locks, and the like may be substituted for the nut and thread combination. An optional handle 64 may be attached to second spacing device 54 to facilitate handling. of either the second spacing device 54 itself, or the entire assembly comprising the first and second spacing devices 38 and 54 (respectively), hollow cylinder 50, hollow shaft 36, and nut 60.

FIGS. 2 and 3 show both an exploded view and an assembled view of a module 66 used to transport and align hollow cylinder 50 in coating vessel 12 (see FIG. 3). Module 66 comprises the hollow cylinder 50 sandwiched between first and second spacing devices 38 and 54 respectively, hollow shaft 36, and nut 60. Nut 60 ensures that the bottom edge of hollow cylinder 50 is in sufficient pressure contact with seal 46 to prevent coating liquid from entering the interior of hollow cylinder 50.

Figure 4:
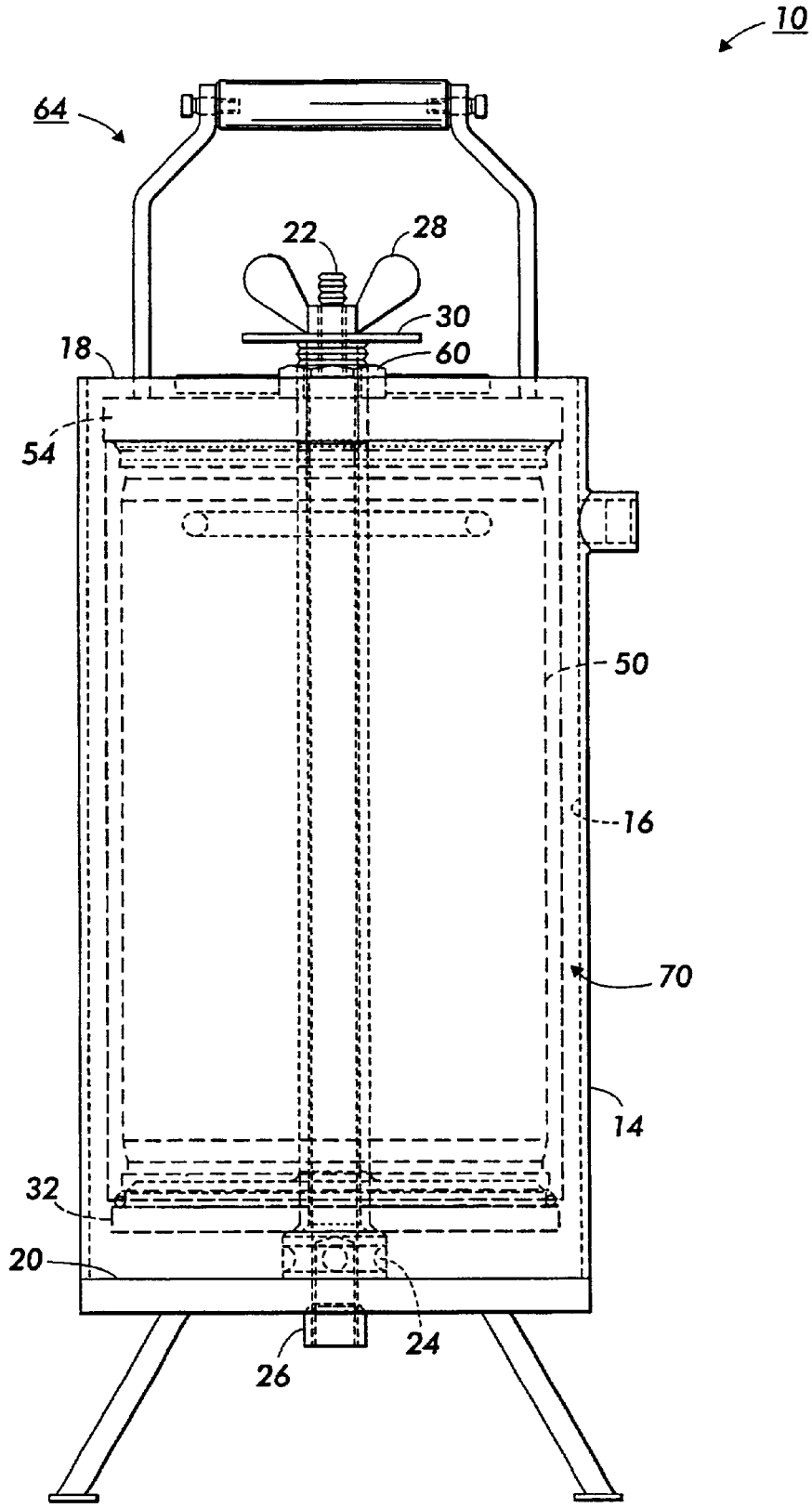
FIG. 4 is a schematic partial cross- sectional view in elevation of the assembly of FIG. 2 mounted in the coating vessel of FIG. 1.

Shown in FIG. 4 is the module 66 installed in coating vessel 12. When hollow shaft 36 is slid downwardly over vertical shaft 22, the bottom of first spacing device 32 rests against outlet 24 which ensures that the coating fluid is introduced and removed form coating vessel 12 at a level below the bottom of hollow cylinder 50. If coating fluid is introduced or removed from coating vessel 12 from some other location than at the base of vertical shaft 22, a suitable stop support (not shown) may be used at or near the base of vertical shaft 22 to allow coating fluid to be introduced or removed from coating vessel 12 at a level that is lower than the bottom of hollow cylinder 50. Such lower level introduction of coating liquid minimizes distortion of deposited coatings on hollow cylinder 50.

When module 66 is fully lowered into coating vessel 12, the threaded upper end of vertical shaft 22 extends beyond the second open end 40 of hollow shaft 36. This allows a second fastening mechanism such as washer 30 and wing nut 28 to be installed on the threaded upper end of vertical shaft 22. Tightening of wing nut 28 urges hollow shaft 36 toward the bottom of the coating vessel 12 and ensures that the hollow cylinder 50 is concentric with the adjacent vertical interior surface 16 of coating vessel 12 during the application of coating liquid. If desired, any suitable alternative fastening mechanism such as cam locks, and the like may be substituted for the wing nut and thread combination.

After installation of module 66 in coating vessel 12, coating liquid is introduced into the annular space 70 between the outer surface of hollow cylinder 50 and the vertical interior surface 16, the surfaces being concentric to each other. It is important for uniform coatings that the outer surface of hollow cylinder 50 be perfectly centered and concentric with vertical interior surface 16 after mounting in coating vessel 12 for each and every coating operation. The arrangement utilized in this invention also prevents undesirable wobbling or vibration of the hollow cylinder 50 during coating application. Moreover, heavy hollow cylinders can be readily handled without using expandable chucks which cannot hold the heavy hollow cylinders.

Sufficient coating liquid is thereafter introduced into space 70 to raise the level of the coating liquid to a point just below the top of hollow cylinder 50. The filling speed is preferably slow to prevent any presence of air bubbles. After a waiting period to ensure that the liquid level within the space 70 is stable, the coating liquid is withdrawn from space 70 at a suitable predetermined rate to achieve the desired coating thickness. The coating liquid withdrawal rate is preferably the same rate as the pull rate used in conventional dip coating where a drum is dipped into a coating bath and thereafter withdrawn and where the dimensions of both the hollow cylinder 50 and coating vessel 12 are the same as that used for conventional dip coating. Such calculation can be based on the fact that the pull rate of the hollow cylinder 50 is equal to the liquid velocity flowing down on the outer surface of hollow cylinder 50 and, hence, the withdrawal rate is the product of pull rate and flow area occupied by coating liquid. Introduction and removal of coating liquid may be accomplished with any suitable technique. The liquid coating withdrawal rate is also affected by various factors such as the specific solvents, pigments (if any), and film forming binders used, concentrations thereof, desired thickness sought, and the like. Typical techniques include, for example, pumping, pneumatic pressure, and the like.

The coating vessel, the vertical shaft, the spacing devices, hollow shaft and other components of the immersion coating system may comprise any suitable material that is resistant to the solvent utilized in the coating materials. Preferably, the materials are metal because metal is more rigid. Typical metals include, for example, stainless steel, and the like. Typical composite materials include glass fiber reinforced plastic, glass, and the like.

The outer surface of the hollow cylinder 50 may be separated from the vertical interior surface 16 of the vessel 12 at any suitable distance (gap) 70 (see FIG. 4) ranging for example from about 5 millimeters to about 5 centimeters, and preferably from about 10 millimeters to about 3 centimeters. An optimum gap between the outside surface of the drum and the inside surface of the cylindrical coating vessel is about 8 millimeters (⅕ inch). Typically, the volume of the space ranges for example from about 140 cubic centimeters to about 5000 cubic centimeters depending on the length and diameter of the substrate to be coated and the coating gap used. For example, the smaller volume is that calculated for a 30 millimeter diameter drum of 253 millimeter length and a 1 centimeter coating gap. The larger volume is that for a drum of 230 millimeter diameter and a length of 500 millimeter and a coating gap of 1 centimeter. At least a portion of the space occupied by gap 70, preferably to almost the top of hollow cylinder 50, is filled with a liquid coating material via, for example, the liquid coating entrance and outlet 24. Thus, the filling of the space occupied by gap 70 with the coating mixture is stopped slightly below the top of the substrate.

The coating mixture is withdrawn from the space occupied by gap 70 (the space between hollow cylinder 50 and vertical interior wall 16 of coating vessel 12 via any suitable outlet, for example, outlet 24. Any suitable device such as a pump (not shown) moves the liquid coating material out of the space occupied by gap 70 in a downward direction along the outer surface of hollow cylinder 50 and out outlet 24. Any suitable pump may be used to move the coating material out of the space occupied by gap 70. Typical pumps include, for example, gear pumps, centrifugal pumps, positive displacement pumps, metering pumps, and the like. The rate of removal of the coating mixture from the space occupied by gap 70 may be controlled by any suitable technique. Typical techniques include, for example, altering the pumping rate by means of a variable speed motor, adjustable valve, and the like. Generally, the pumping rate removes the coating material at a predetermined constant rate. If desired, the varied withdrawal rate described in U.S. patent application Ser. No. 09/466,565, entitled "IMMERSION COATING PROCESS", filed concurrently herewith in the names of Dinh et al., may be used. The entire disclosure of this application is incorporated herein by reference. The aforementioned co-pending application is assigned to Xerox Corporation.

A predetermined constant coating material withdrawal rate is the rate which deposits the desired coating thickness for the particular coating mixture utilized. This rate is essentially identical to the constant drum withdrawal rate that is used in conventional dip coating processes where the drum is removed from a coating bath to obtain a desired coating thickness.

The predetermined constant rate of removal depends upon various factors such as the length and diameter of the substrate, the coating composition materials and physical characteristics, the desired coating thickness to be deposited, the spacing between the drum surface and the adjacent interior surface of the coating vessel, and the like. Withdrawal at the substantially the predetermined constant flow rate is preferably uniform to ensure that the deposited coating during the period of constant flow rate has a substantially uniform thickness. Typical constant rates are at a rate where the surface of the coating mixture descends at a rate ranging, for example, from about 50 millimeters/min. to about 500 millimeters/min., and preferably from about 100 millimeters/min. to about 400 millimeters/min. This rate the rate at which the top surface of the coating mixture bath travels along the surface of the stationary drum being coated The substrate may be coated with a plurality of layers by repeating the steps of filling at least a portion of the space with the respective coating mixture and withdrawing the respective coating mixture from the space, thereby forming a new layer over the previous layer or layers on the substrate. The deposition of the plurality of the layers may be accomplished without moving the substrate from the vessel. It is preferred to introduce a gas such as air into the space after withdrawal of the first coating mixture from the space but prior to filling of the space with the second coating mixture to at least partially dry the layer of the first coating mixture on the substrate and any remaining first coating mixture in the coating vessel. Preferably, all of the remaining first coating mixture is dried prior to introduction of the second coating mixture in the vessel. The use of the drying gas may avoid contamination of the subsequent coating mixture from insufficiently dry or wet residues of the previous coating mixture. The drying gas may be for example air and the gas may have a temperature higher than room temperature such as a temperature ranging for instance from about 30° C. to about 70° C. The drying gas should be gently introduced at a pressure ranging for example from about 10 to about 30 psi to avoid disrupting the coated layer. The expression "coating mixture" as employed herein is defined as either a dispersion of particles dispersed in a liquid or a solution of a soluble materials such as a film forming polymer in a liquid. Although the step of initiating removal of the coating mixture at a gradually increasing rate to a predetermined maximum flow rate in a short predetermined distance, may be employed to apply any suitable coating mixture, it must be used in the process of this invention to apply dispersions such as a dispersion of charge generating particles dispersed in a solution of a film forming polymer.

The dry thickness of each coated layer on the substrate may be relatively uniform and may be for example from about 0.3 micrometer to about 40 micrometers in thickness. Preferably, the portion of the coated layer over the lower end region of the drum should not be excessively thicker than the rest of the coated layer using the present invention.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 30 microns, although the thickness can be outside of this range. When a flexible electrophotographic imaging member is desired, the substrate thickness typically is from about 0.015 millimeter to about 0.15 millimeter. The concept of this invention may also be utilized for coating flexible belts. Large belts, those, for example, having a 2–3 pitch circumference may be readily coated by the apparatus of this invention. Generally, an expandable support inside the belt is utilized in combination with the hollow center post and upper and lower flanges ensure that the belt is aligned concentrically with the inner wall of the coating vessel. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as Mylar® (available from DuPont) or Melinex 447® (available from ICI Americas, Inc.), and the like. If desired, a conductive substrate can be coated onto an insulating material. In addition, the substrate can comprise a metallized plastic, such as titanized or aluminized Mylar®. The coated or uncoated substrate can be flexible or rigid, and can have any number of configurations such as a cylindrical drum, an endless flexible belt, and the like. The substrates preferably have a hollow, endless configuration. If the substrate is flexible, a supporting expandable chuck may be used to maintain the shape of the substrate during the immersion coating process of this invention.

Each coating mixture may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the entire disclosures of these patents being incorporated by reference.

In embodiments, a coating mixture may include the materials for a charge barrier layer including, for example, polymers such as polyvinylbutyral, epoxy resins, polyesters, polysiloxanes, polyamides, polyurethanes, and the like. Materials for the charge barrier layer are disclosed in U.S. Pat. Nos. 5,244,762 and 4,988,597, the disclosures of which are totally incorporated by reference.

In other embodiments, a coating mixture may be formed by dispersing any suitable charge generating particles in a solution of a film forming polymer. Typical charge generating particles include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; azulene compounds; and the like. Typical film forming polymers include, for example, polyester, polystyrene, polyvinylbutyral, polyvinyl pyrrolidone, methyl cellulose, polyacrylates, cellulose esters, vinyl resins and the like. Preferably, the average particle size of the pigment particles is between about 0.05 micrometer and about 0.10 micrometer. Generally, charge generating layer dispersions for immersion coating mixtures contain pigment and film forming polymer in the weight ratio of from 20 percent pigment/80 percent polymer to 80 percent pigment/20 percent polymer. The pigment and polymer combination are dispersed in solvent to obtain a solids content of between 3 and 6 weight percent based on total weight of the mixture However, percentages outside of these ranges may be employed so long as the objectives of the process of this invention are satisfied. A representative charge generating layer coating dispersion comprises, for example, about 2 percent by weight hydroxy gallium phthalocyanine; about 1 percent by weight of terpolymer of vinyl acetate, vinyl chloride, and maleic acid (or a terpolymer of vinylacetate, vinylalcohol and hydroxyethylacrylate); and about 97 percent by weight cyclohexanone. Coating defects can readily be identified in deposited charge generating layers because the deposited layers are colored and the underlying layer is white.

In other embodiments, a coating mixture may be formed by dissolving any suitable charge transport material in a solution of a film forming polymer. Typical charge transport materials include, for example, compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds. Typical film forming polymers include, for example, resins such as polycarbonate, polymethacrylates, polyarylate, polystyrene, polyester, polysulfone, styrene-acrylonitrile copolymer, styrene-methyl methacrylate copolymer, and the like. An illustrative charge transport layer coating composition contains, for example, about 10 percent by weight N,N'-diphenyl-N,N'-bis(3-methylphenyl)-[1,1'-biphenyl]-4,4'diamine; about 14 percent by weight poly(4,4'-diphenyl-1,1'-cyclohexane carbonate (400 molecular weight); about 57 percent by weight tetrahydrofuran; and about 19 percent by weight monochlorobenzene.

A coating composition may also contain any suitable solvent, preferably an organic solvent. Typical solvents include, for example, tetrahydrofuran, monochlorobenzene, cyclohexanone, n-butyl acetate, and the like and mixtures thereof.

After all the desired layers are coated onto the substrates, they may be subjected to elevated drying temperatures such as, for example, from about 100° C. to about 160° C. for about 0.2 hours to about 2 hours.

The system of this invention involves immersion coating of hollow cylinders in an essentially closed environment using a minimum amount of coating fluid and without requiring precise motion control of potentially massive substrates over large distances, as in ordinary dip coating systems in which the hollow cylinders are inserted and then removed from a coating vessel containing coating liquid. It also provides a particle free environment, which eliminates the need for transporting a drum from one coating vessel to another to apply multiple different coatings. The coating system of this invention also facilitates the coating of very heavy drums, which would fall out of conventional chucking devices utilized for dipping the drums into coating baths and thereafter withdrawing them. Moreover, with heavy drums, the immersion of the drum into a bath and subsequent withdrawal is difficult to achieve with accuracy because of wobble and vibration. Thus, problems encountered with small drums are exaggerated or magnified when large drums are dip coated. A typical large drum may have a diameter greater than about 9 inches. Specific examples of typical problems include incomplete and irregular bottom edge wipe of the bottom edge of the drums, coating deposition on the inside surface of the drum, and excessive burping where air trapped in the interior of a drum escapes around the uncovered bottom edge forming bubbles that disrupt the uniformity of the coating being formed on the outside surface of the drum. This burping problem is exacerbated by the large volume of air in large drums. Moreover, dip coating of large drums by immersion into a bath displaces a very large volume of coating material, which increases cost, results in substantial solvent loss, and the like. Moreover, the coating system of this invention can also permit transfer of large drums from one coating vessel to another without the need for chucks.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

An undercoat layer coating solution was prepared comprising 6.7 percent by weight polyamide film forming polymer and 93.3 percent by weight of a mixture of methanol/n-butanol/water in a proportion of 9/4/1, respectively. The dip coating apparatus described above was used to apply the above undercoating solution to an aluminum drum to give a coating of 1.2 micrometers after drying at a temperature of 110° C. for 30 minutes. The drum was 50 centimeters long and had an outside diameter of 24.1 centimeters. This drum was mounted in the coating device as shown in FIG. 4. The gap space between the outer surface of the coated drum and the adjacent coating vessel wall was 10 millimeters. The coating solution was withdrawn with a metering pump at a rate to equal a pull rate of 100 mm/min. The deposited coating was dried at 120° C. for 20 minutes.

EXAMPLE II

A charge generating layer coating dispersion comprising 2 percent by weight hydroxy gallium phthalocyanine; 1 percent by weight of terpolymer of vinyl acetate, vinyl chloride, and maleic acid [or a terpolymer of vinylacetate, vinylalcohol and hydroxyethylacrylate]; and about 97 percent by weight cyclohexanone. The dip coating apparatus described above was used to apply the charge generator dispersion to the aluminum drum from Example I. The gap space between the outer surface of the coated drum and the adjacent coating vessel wall was 10 millimeters. Removal of the coating dispersion was initiated at a gradually increasing rate to a target flow rate equivalent to a coating speed of 200 millimeters/min. in a predetermined distance of 10 millimeters in 15 seconds using a positive displacement pump driven by a variable speed motor and further removal was continued at the predetermined flow rate equivalent to a target coating speed equivalent to 200 mm/min to deposit on the substrate a layer of the coating mixture having a dry film thickness of about 0.5 micrometer, after drying of the deposited coating at 110° C. for 30 minutes. The coated drum was visually examined with the naked eye. No coating defects were found.

EXAMPLE III

A charge transport layer coating solution was prepared comprising 7 percent by weight polyarylamine, 13 percent by weight polycarbonate film forming polymer and about 80 percent by weight of a mixture of monochlorobenzene and tetrahydrofuran solvents. The dip coating apparatus described above was used to apply the above charge transporting solution to an aluminum drum that had a 1.2 micrometer thick polyamide blocking layer and a 0.5 micrometer thick charge generator layer to give a coating of 20 micrometers after drying at a temperature of 115° C. for 35 minutes. The drum was 50 centimeters long and had an outside diameter of 24.1 centimeters. This drum was mounted in the coating device as shown in FIG. 4. The gap space between the outer surface of the coated drum and the adjacent coating vessel wall was 10 millimeters. The coating solution was withdrawn with a metering pump at a rate to equal a pull rate of 250 mm/min.

EXAMPLE IV

The thickness of under coat layers (UCL) of Example I and charge transport layers (CTL) of Example III were measured by Otsuka gauge at 4 different angular positions, 0°, 90°, 180° and 270° around the drums and every 1 cm from the top of the coating for a total of 12 readings at each of the angular positions. The average thickness of the UCL (3-component UCL) of Example I was about 1.2 micrometers with standard deviation of 6.6 percent. The average thickness of the CTL in Example II was about 19.7 micrometers with 5.8 percent standard deviation. The thickness uniformity within a drum is comparable to that obtained in conventional dip coating processes.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A coating process comprising providing an assembly comprising a hollow cylinder, a hollow shaft coaxial with the cylinder connecting a first spacing device and a second spacing device wherein said first spacing device and said second spacing device are connected to said cylinder, mounting the assembly on a vertical rod which is concentric to and mounted within a cylindrical coating vessel having a top and bottom, introducing coating liquid into the coating vessel adjacent to the bottom to immerse most of the cylinder, and withdrawing the liquid from the coating vessel adjacent to the bottom to deposit a layer of the coating liquid on the outside of the hollow cylinder and wherein a liquid seal is formed between the top and bottom of the cylinder and hollow shaft.

2. A coating process according to claim 1 wherein the coating liquid is withdrawn with a metering pump at a rate to equal a pull rate of 100 millimeters per minute.

3. A coating process according to claim 1 wherein the coating liquid deposited on the cylinder is dried at 120° C. for 20 minutes.

4. A coating process according to claim 1 wherein the coating liquid deposited on the cylinder is dried at 110° C. for 30 minutes.

5. A coating process according to claim 1 wherein the coating liquid is withdrawn with a metering pump at a rate to equal a pull rate of 250 millimeters per minute.

6. A coating process according to claim 1 wherein the outer surface of the hollow cylinder is separated from the vertical interior surface of the vessel by a gap space from about 10 millimeters to about 5 centimeters.

7. A coating process according to claim 1 wherein the outer surface of the hollow cylinder is separated from the vertical interior surface of the vessel by a gap space from about 10 millimeters to about 3 centimeters.

8. A coating process according to claim 1 wherein the outer surface of the hollow cylinder is separated from the vertical interior surface of the vessel by a gap space from about 8 millimeters to about 10 millimeters.

9. A coating process according to claim 1 wherein the outer surface of the hollow cylinder is separated from the vertical interior surface of the vessel by a gap space of about 10 millimeters.

10. A coating process according to claim 1 wherein the coating liquid is an undercoat layer coating solution.

11. A coating process according to claim 10 wherein the undercoat layer coating solution comprises from about 6.7 percent by weight polyamide film forming polymer and about 93.3 percent by weight of a mixture of methanol/n-butanol/water is a proportion of about 9/4/1, respectively.

12. A coating process according to claim 1 wherein the coating liquid is a charge generating layer coating solution.

13. A coating process according to claim 12 wherein the charge generating layer coating solution comprises a) about 2 percent by weight hydroxy gallium phthalocyanine;

b) about 1 percent by weight of a terpolymer of vinyl acetate, vinyl chloride, and maleic acid or a terpolymer of vinylacetate, vinylalcohol and hydroxyethylacrylate; and c) about 97 percent by weight of cyclohexanone.

14. A coating process according to claim 1 wherein the coating liquid is a charge transport layer coating solution.

15. A coating process according to claim 14 wherein the charge transport layer coating solution comprises a) about 7 percent by weight polyarylamine, b) about 13 percent by weight polycarbonate film forming polymer; and c) about 80 percent by weight of a mixture of monochlorobenzene and tetrahydrofuran.

* * * * *